US012065789B1

(12) United States Patent
Keghlian

(10) Patent No.: US 12,065,789 B1
(45) Date of Patent: Aug. 20, 2024

(54) HAND-CARRYABLE HEATING AND DISPENSING APPARATUS FOR TAR, BITUMEN, ASPHALT, AND THE LIKE

(71) Applicant: Robert Keghlian, Massapequa, NY (US)

(72) Inventor: Robert Keghlian, Massapequa, NY (US)

( * ) Notice: Subject to any disclaimer, the term of this patent is extended or adjusted under 35 U.S.C. 154(b) by 496 days.

(21) Appl. No.: 17/370,174

(22) Filed: Jul. 8, 2021

Related U.S. Application Data

(60) Provisional application No. 63/073,970, filed on Sep. 3, 2020.

(51) Int. Cl.
*E01C 19/08* (2006.01)
*E01C 19/17* (2006.01)
*E01C 19/20* (2006.01)

(52) U.S. Cl.
CPC ..... *E01C 19/08* (2013.01); *E01C 19/17* (2013.01); *E01C 19/20* (2013.01); *E01C 2019/206* (2013.01)

(58) Field of Classification Search
CPC ..... E01C 19/08; E01C 19/17; E01C 19/20; E01C 2019/206
See application file for complete search history.

(56) References Cited

U.S. PATENT DOCUMENTS 322,325 A * 7/1885 Schillinger ..... C10C 3/12 126/343.5 A
556,104 A * 3/1896 Palm ..... F23D 14/70 431/171

(Continued)

FOREIGN PATENT DOCUMENTS

CA 2974753 A1 1/2019
CH 157599 A * 10/1932

(Continued)

OTHER PUBLICATIONS

Press Fit Forces Stress Design Calculator, Jun. 18, 2018, available at: www.engineersedge.com/calculators/machine-design/press-fit/press-fit.htm.

(Continued)

*Primary Examiner* — Jorge A Pereiro
*Assistant Examiner* — Logan P Jones
(74) *Attorney, Agent, or Firm* — Thomas A. O'Rourke; James Bongiorno; O'Rourke IP Law PLLC

(57) ABSTRACT

A hand-carryable apparatus to heat tar into a flowable state and dispense the tar includes: a pot with pivotable handle, a shroud with a handle, and a heat chamber, which may all be cylindrical. The shroud extends from a bottom portion of the pot. The heat chamber includes: a base wall, a plurality of baffles, and a cylindrical side wall that slidably receives a portion of the shroud in a clearance fit. An opening in the heat chamber side wall receives the flame end of a torch. Three or more baffles protrude upwardly from the base wall to distribute the heat provided by the torch: a first baffle positioned distally from the opening and oriented substantially perpendicular thereto; and second and third baffles positioned between the first baffle and the opening, and oriented at an acute angle to the first baffle, and symmetrically offset from the axis of the opening.

20 Claims, 9 Drawing Sheets

(56) References Cited

U.S. PATENT DOCUMENTS

| | | | | | |
|---|---|---|---|---|---|
| 599,047 | A | | 2/1898 | Rider | |
| 1,086,911 | A | * | 2/1914 | Gailor | D06F 1/06 126/345 |
| 1,378,637 | A | | 5/1921 | Wall | |
| 1,482,002 | A | | 1/1924 | Friedman | |
| 1,574,489 | A | * | 2/1926 | Kittel | C10C 3/12 126/343.5 A |
| 1,699,732 | A | * | 1/1929 | Balmat | F23C 99/00 431/171 |
| 1,855,961 | A | | 4/1932 | Hargrave | |
| 2,041,359 | A | | 5/1936 | Littleford | |
| 2,048,299 | A | | 7/1936 | Schumann | |
| 2,074,689 | A | | 3/1937 | Gambrill | |
| 2,093,232 | A | | 9/1937 | Coulter | |
| 2,314,329 | A | | 3/1943 | Ericson | |
| 2,396,578 | A | | 3/1946 | Kittel | |
| 2,465,953 | A | | 3/1949 | Wollner | |
| 2,472,594 | A | | 6/1949 | Kuehn | |
| 2,764,973 | A | | 10/1956 | Miller | |
| 2,839,332 | A | | 6/1958 | Sackett | |
| 3,046,977 | A | | 7/1962 | Figge | |
| 3,092,098 | A | * | 6/1963 | Moore | C10C 3/12 126/343.5 A |
| 3,503,382 | A | | 3/1970 | Wollner | |
| 3,577,976 | A | | 5/1971 | Heller | |
| 3,721,226 | A | * | 3/1973 | Childree | E01C 19/10 105/451 |
| 3,804,079 | A | | 4/1974 | Schrader | |
| 3,946,722 | A | | 3/1976 | Banahan | |
| 4,015,588 | A | | 4/1977 | Blackwell | |
| 4,159,877 | A | | 7/1979 | Jacobson | |
| 4,620,645 | A | | 11/1986 | Hale | |
| 4,905,663 | A | | 3/1990 | Magee | |
| 5,333,600 | A | * | 8/1994 | Fitzpatrick | E04D 15/07 432/160 |
| 5,832,178 | A | | 11/1998 | Schave | |
| 6,109,826 | A | | 8/2000 | Mertes | |
| 6,439,806 | B1 | | 8/2002 | Dillingham | |
| RE40,307 | E | | 5/2008 | Pollock | |
| 8,388,215 | B2 | | 3/2013 | Kay | |
| 9,732,280 | B1 | | 8/2017 | Hollar | |
| 9,771,691 | B2 | | 9/2017 | Howseman | |
| 2005/0115558 | A1 | * | 6/2005 | Farmer | E04D 15/00 126/373.1 |

FOREIGN PATENT DOCUMENTS

| | | | | | |
|---|---|---|---|---|---|
| CN | 102319029 | B | | 1/2012 | |
| CN | 205420286 | U | | 8/2016 | |
| DE | 708836 | C | * | 7/1941 | |
| DE | 19816737 | A1 | * | 10/1999 | C10C 3/12 |
| FR | 562674 | A | * | 11/1923 | |
| FR | 614626 | A | | 12/1926 | |
| FR | 999891 | A | | 2/1952 | |
| GB | 264038 | A | | 1/1927 | |
| GB | 359941 | A | | 10/1931 | |
| GB | 688297 | A | | 3/1953 | |
| GB | 803360 | A | | 10/1958 | |
| GB | 1022428 | A | * | 3/1966 | |

OTHER PUBLICATIONS

"Three General Types of Fit," available at www.mmto.org/dclark/Reports/Encoder%20Upgrade/fittolerences%20%5BRead-Only%5D.pdf., Jul. 8, 2019.

"Engineering Fit," available at: https://en.wikipedia.org/wiki/Engineering_fit, Jul. 8, 2019.

* cited by examiner

HAND-CARRYABLE HEATING AND DISPENSING APPARATUS FOR TAR, BITUMEN, ASPHALT, AND THE LIKE

CROSS REFERENCES TO RELATED APPLICATIONS

This application claims priority on U.S. Provisional Application Ser. No. 63/073,970, filed on Sep. 3, 2020, the disclosures of which are incorporated herein by reference.

FIELD OF THE INVENTION

The subject technology relates generally to apparatus for heating a substance so it may be properly utilized in the field, and more particularly relates to a hand-carryable apparatus for heating tar into a suitably flowable state and for dispensing it therefrom, while maintaining the tar in the flowable state longer when the apparatus is placed on the ground for a sustained period of time.

BACKGROUND OF THE INVENTION

There are a number of construction applications that require a heated tar, or asphalt, or bitumen, or the like, and some of which require the product to suitably flow from a container, and which requires particular apparatus for accomplishing such heating and dispensing of those flowable products in the field.

Devices/methods that may be related, may be shown by the following: GB803,360, to Williams; U.S. Pat. No. 2,041,359 to Littleford; U.S. Pat. No. 2,314,329 to Ericson; U.S. Pat. No. 2,839,332 to Scakett; U.S. Pat. No. 3,046,977 to Figge; U.S. Pat. No. 3,503,382 to Wollner; U.S. Pat. No. 4,015,588 to Blackwell; U.S. Pat. No. 4,620,645 to Hale; U.S. Pat. No. 9,732,280 to Hollar; and U.S. Pat. No. 9,771,691 to Howseman. It is noted that citing within this disclosure of any patents, published patent applications, and non-patent literature is not an admission as to any of those references constituting prior art with respect to the herein disclosed and claimed apparatus.

The herein disclosed apparatus provides improvements upon certain earlier apparatus, including more even heating of the substance in the pot/kettle; easier dispensing of the substance once ready for use after being heated into a suitably flowable state; and less heat loss from the pot/kettle during dispensing of the substance, permitting a more sustained period of time that it may be set on the ground during/between field uses, before needing to be reheated.

OBJECTS OF THE INVENTION

It is an object of the invention to provide apparatus that may be used in the field to heat tar, bitumen, asphalt or the like.

It is another object of the invention to provide apparatus for heating tar or the like into a suitably viscous state, and which apparatus may be hand-carried by a single individual from a vehicle out to a site where the tar may need to be heated and utilized.

It is a further object of the invention to provide apparatus for heating tar or the like into a suitably viscous state, and which apparatus may also easily facilitate dispensing of the heated tar at the site from the pot/kettle.

It is another object of the invention to provide apparatus for heating tar, bitumen, asphalt or the like into a suitably viscous state, and which may provide for more evenly distributed heating of the substance within the pot/kettle.

It is also an object of the invention to provide apparatus for dispensing of heated tar or the like, which may be less susceptible to heat loss when used in the field for dispensing of the heated tar where is tends to be periodically set on the ground.

It is another object of the invention to provide apparatus for heating tar, bitumen, asphalt or the like, and which apparatus may utilize a standard torch that is fueled by a tank of propane gas.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In accordance with at least one of the disclosed embodiments, a hand carryable heating and dispensing apparatus configured to heat tar, bitumen, asphalt, or the like may include: a pot, a shroud, and a particularly configured heating chamber. The pot may include: a bottom wall, and one or more side walls extending upwardly from the bottom wall, which may be a single cylindrical side wall. The shroud may be formed as a separate part, or may be integrally formed with the pot, or may be integrally formed with the heat chamber, in accordance with various different embodiments.

In one embodiment, the shroud may be configured to extend down from a bottom portion of the pot, either from its bottom wall, or from its side wall, or from the transition between its bottom wall and side wall. The heat chamber may include: a base portion, and one or more side walls extending upwardly from the base portion. The one or more side walls of the heat chamber may be formed as a cylindrical wall that is configured to slidably receive the cylindrical wall of the shroud therein using a clearance fit. The heat chamber may have an opening in its side wall, which opening may be sized and configured to receive the flame producing end of a torch that may be a standard torch that uses propane from a small, conventional, portable tank. The heat chamber may also have a hollow cylindrical protrusion configured to extend away from the opening in its side wall, which may be used to receive and stably support the flame end of the torch in a substantially horizontal position.

The heat chamber has a plurality of baffles that are configured to protrude upwardly from the base wall. A handle may be configured to permit removal of the pot and the shroud from the heat chamber after the tar has been sufficiently heated. In the embodiment where the shroud is integral with, or fixedly secure to, the pot, the side wall of the shroud is configured to support the pot distally from a ground surface while resting thereon, during which intermittent/alternate time periods a worker may spend working the tar into a crack or be preforming other tasks before returning to dispensing of the tar. Having only the small narrow thickness of the rim of the shroud on the ground while performing those other tasks sharply reduces the amount of heat transfer from the pot and tar, as compared with the heat transfer that would occur by placing the entire surface area of the bottom of the metal pot onto the ground.

This permits longer use of a batch of tar heated in the pot/kettle before reheating may be required to again place it into a suitably flowable state.

The plurality of baffles may include: a first baffle, a second baffle, and a third baffle. In one embodiment, the first baffle may be substantially flat, and may be positioned distally from the opening in the side wall of the heat chamber, and may also be oriented substantially perpendicular to an axis of the opening, and be substantially centered with respect to the axis of the opening. The second and third baffles may also be substantially flat, and may be positioned between the first baffle and the opening in the side wall of the heat chamber. The second and third baffles are preferably oriented at an acute angle with respect to the axis of the opening (i.e., each may be roughly at an angle to the first baffle being in the range of 30 degrees to 60 degrees. The first and second baffles are also substantially symmetrically offset with respect to the axis of the opening, so that heat from the torch may be directed straight at a portion of each of the three baffles. In another embodiment, the baffles, rather than being entirely flat and protruding straight up from the bottom of the heat chamber may instead have a curved bottom portion to induce the flame and/or heat to be gradually directed upwardly, rather than striking the baffle horizontally.

To limit the sliding engagement of the cylindrical side wall of the shroud within the cylindrical side wall of the heat chamber, the side wall of the shroud may have a protruding stop member. Also, to establish clocking of the pot/kettle with respect to the heat chamber, to keep the handle, which is preferably pivotable, away from the torch, the protruding stop member may be configured to act as a "key" and be received within a corresponding recess (i.e., a keyway) in the side wall of the heat chamber. The key and keyway may preferably be positioned to orient the handle 180 degrees away from the position if the torch, i.e., 180 degrees away from the opening in the heat chamber.

The shroud may also have a handle protruding therefrom, so that the lower part of the pot and shroud assembly may be supported, while the pivotable handle of the pot may be lowered to establish dispensing of the tar when desired. The shroud or the heat chamber may have a post that protrudes upwardly to provide support for the pivotable handle at a distance away from the pot, to prevent it from being heated to an extent that makes it difficult or uncomfortable to handle, while the tar in the pot is being heated.

BRIEF DESCRIPTION OF THE DRAWINGS

The description of the various example embodiments is explained in conjunction with appended drawings, in which:

FIG. 1 is an exploded view of component parts that may be used for one or more embodiments of a hand-carryable heating and dispensing apparatus configured to heat tar, bitumen, asphalt, or the like;

DETAILED DESCRIPTION OF THE INVENTION

Figure 1:
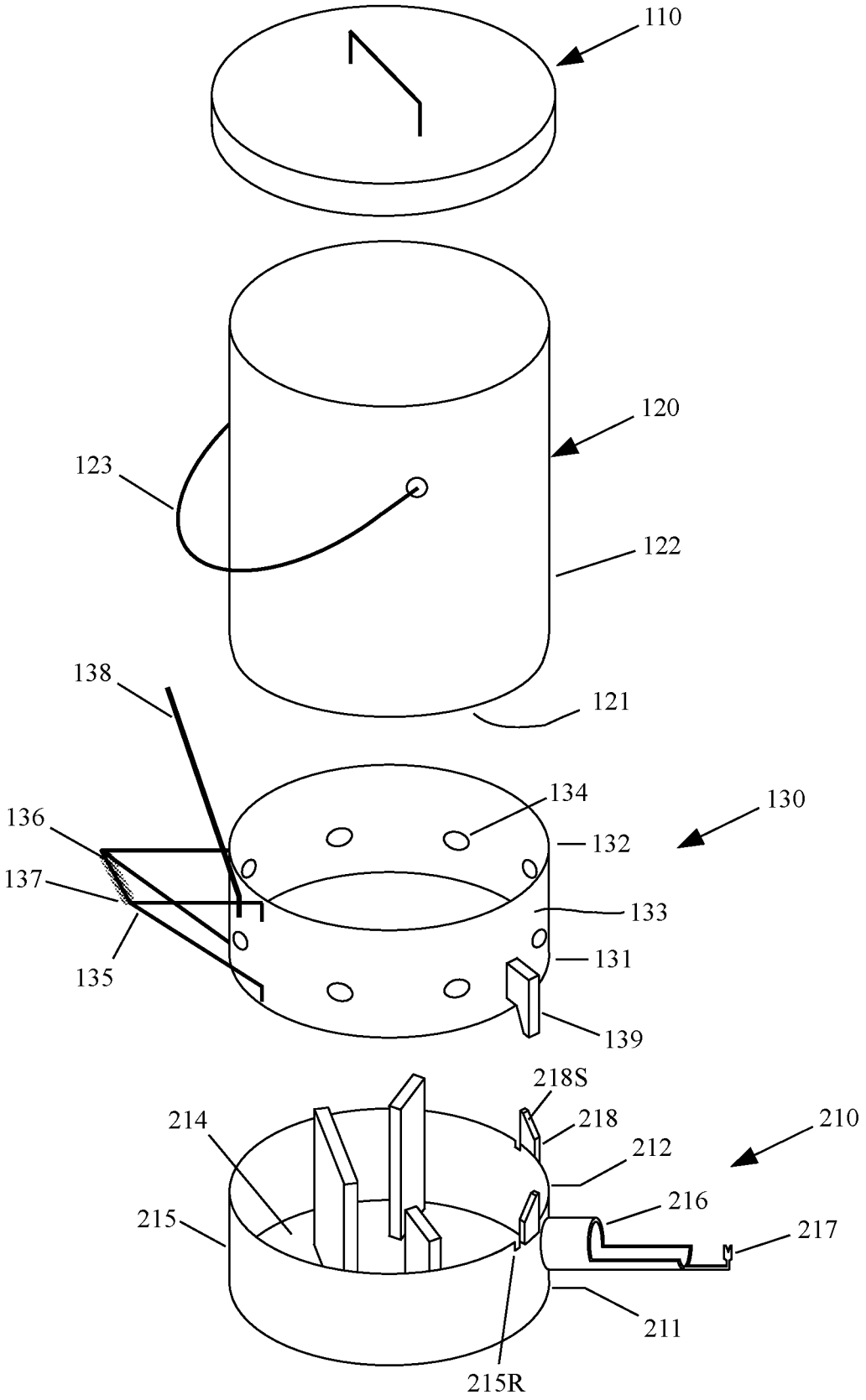

As used throughout this specification, the word "may" is used in a permissive sense (i.e., meaning having the potential to, or being optional), rather than a mandatory sense (i.e., meaning must), as more than one embodiment of the invention may be disclosed herein. Similarly, the words "include", "including", and "includes" mean including but not limited to.

The phrases "at least one", "one or more", and "and/or" may be open-ended expressions that are both conjunctive and disjunctive in operation. For example, each of the expressions "at least one of A, B and C", "one or more of A, B, and C", and "A, B, and/or C" herein means all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, It is noted that the citing of any reference within this disclosure, i.e., any patents, published patent applications, and non-patent literature, is not an admission regarding a determination as to its availability as prior art with respect to the herein disclosed and claimed apparatus/method.

Furthermore, any reference made throughout this specification to "one embodiment" or "an embodiment" means that a particular feature, structure or characteristic described in connection therewith is included in at least that one particular embodiment. Thus, the appearances of the phrases "in one embodiment" or "in an embodiment" in various places throughout this specification are not necessarily all referring to the same embodiment. Therefore, the described features, advantages, and characteristics of any particular aspect of an embodiment disclosed herein may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with design variations as described in the specification, as well as applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of a multiplicity of such individual tolerances.

Any use of a friction fit (i.e., an interface fit) between two mating parts described herein indicates that the opening (e.g., a hole) is smaller than the part received therein (e.g., a shaft), which may be a slight interference in one embodiment in the range of 0.0001 inches to 0.0003 inches, or an interference of 0.0003 inches to 0.0007 inches in another embodiment, or an interference of 0.0007 inches to 0.0010 inches in yet another embodiment, or a combination of such ranges. Other values for the interference may also be used in different configurations (see e.g., "Press Fit Engineering and Design Calculator," available at: www.engineersedge.com/calculators/machine-design/press-fit/press-fit-calculator.htm).

Any described use of a clearance fit indicates that the opening (e.g., a hole) is larger than the part received therein (e.g., a shaft), enabling the two parts to move (e.g. to slide and/or rotate) when assembled, where the gap between the opening and the part may depend upon the size of the part and the type of clearance fit—i.e., loose running, free running, easy running, close running, and sliding (e.g., for a 0.1250 inch shaft diameter the opening may be 0.1285 inches for a close running fit, and may be 0.1360 inches for a free running fit; for a 0.5000 inch diameter shaft the opening may be 0.5156 inches for a close running fit and may be 0.5312 inches for a free running fit). Other clearance amounts are used for other clearance types. See "Engineering Fit" at: https://en.wikipedia.org/wiki/Engineering_fit; and "Three General Types of Fit," available at www.mm-to.org/dclark/Reports/Encoder %20Upgrade/fittolerences %20%5BRead-Only %5D.pdf.

As used herein, the term "hand-carryable" describes that the entire assembled apparatus has an ergonomic size, weight, and shape which allows it to be easily and conveniently held and carried by an average-sized human hand.

Figure 2:
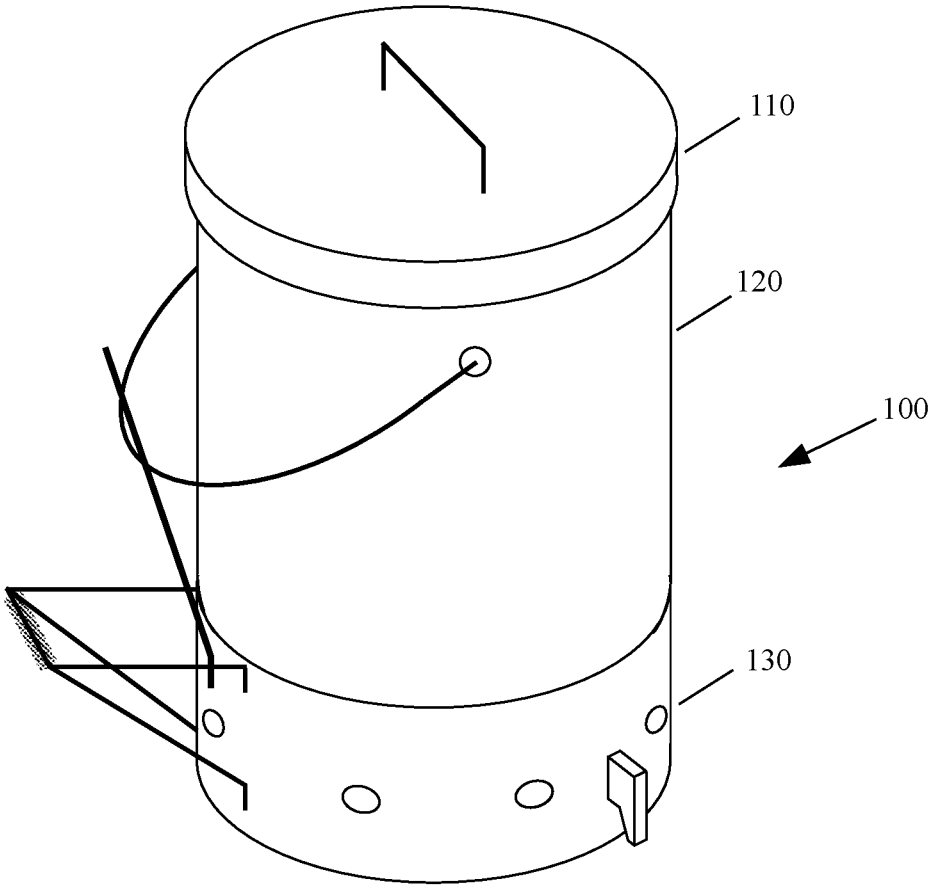
FIG. 2 shows one embodiment of the hand-carryable apparatus that may be used to dispense tar or the like at a job site after it has been heated into a desired flowable state.
Figure 3:
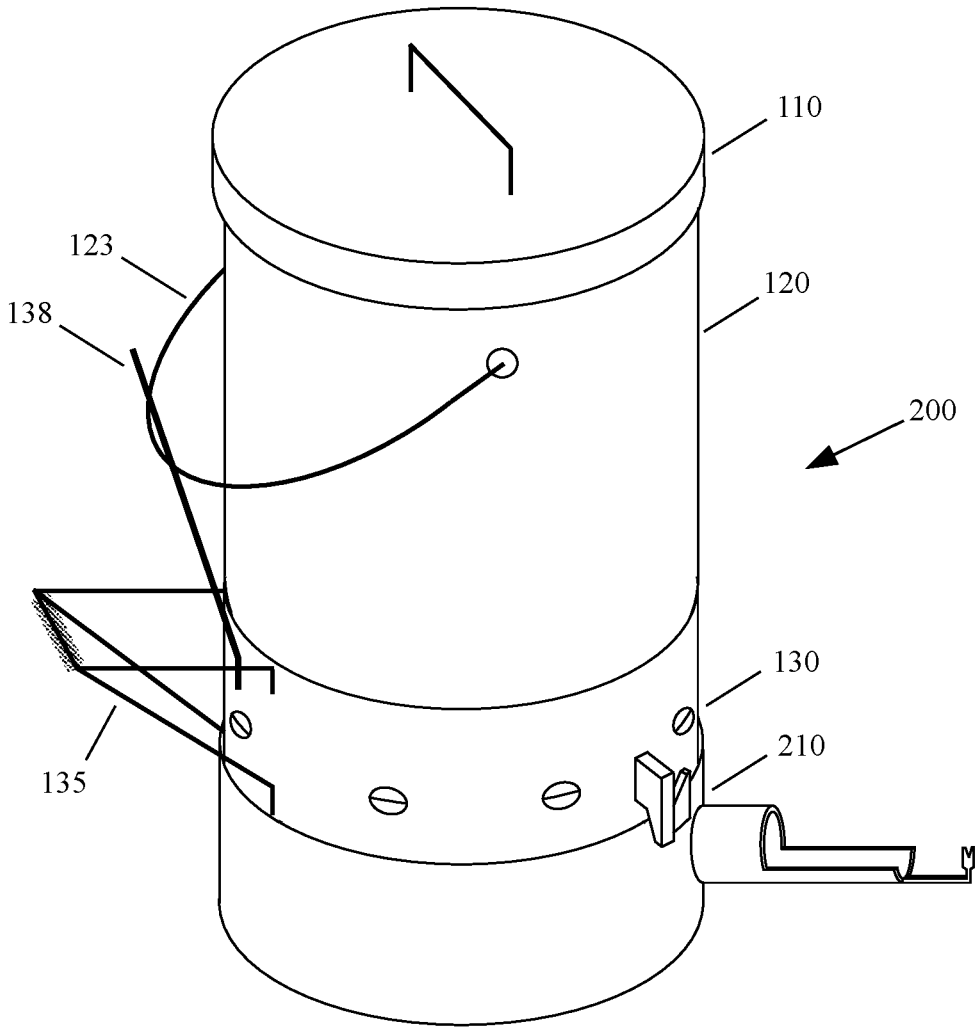
FIG. 3 shows the dispensing portion of the hand-carryable apparatus for heating tar or the like, after being seated at the top of the heat chamber.

FIG. 2 shows a first embodiment of a hand-carryable apparatus 100 that may be used to dispense tar or the like at a job site after it has been heated into the desired flowable state, which heating may be accomplished using the assembly 200 shown in FIG. 3, which includes the dispensing apparatus 100 and the heat chamber 210.

In this first embodiment the dispensing apparatus 100 may primarily include a pot 120, and a shroud 130. During heating of the tar in the pot 120, it may preferably kept covered using cover 110, which may simply slide onto the top of the pot (e.g., having a larger size/diameter), or which may instead be threadably coupled to the pot.

As may be seen in FIG. 1, the pot 120 may include: a bottom wall 121, and one or more side walls extending upwardly from the bottom wall, which may be a single cylindrical side wall 122. Although a cylindrical pot, as well as a cylindrical shroud and cylindrical heat chamber may be preferable, it is understood that other cross-section shaped may be used to form those pieces of apparatus, instead of a circular base and cylindrical wall. Each of those pieces of apparatus may alternatively be formed of a rectangular base with four rectangular walls, or an octagonal base with eight rectangular walls, or any other suitable base shape with correspondingly shaped walls. However, for simplicity, the specification hereinafter describes those pieces of apparatus as each being formed using a circular bottom wall and/or a cylindrical side wall, without intending to be so limiting for the shapes that may alternatively be utilized.

Figure 6:
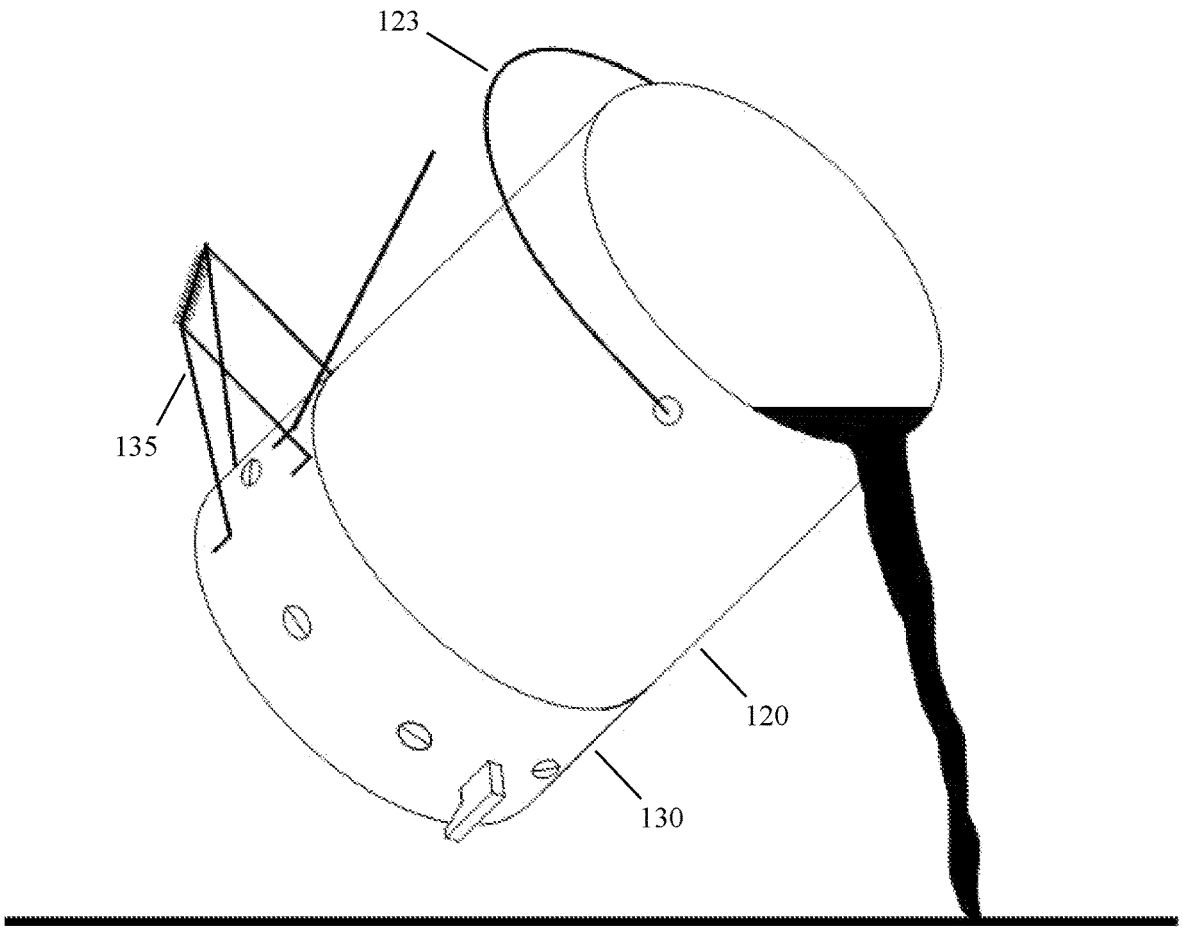
FIG. 6 shows the hand-carryable apparatus of FIG. 2, but is shown after the tar has been heated using the arrangement of FIG. 5, and after the cover has been removed from the pot, with the pot being held at an angle using the two handles to dispense the heated tar.

The pot 120 may have a handle 123 pivotally attached to the sidewall 122, which may advantageously permit pouring of the heated tar from the pot (see e.g., FIG. 6). Alternatively or additionally, the pot 120 may have one or more handles fixedly secured to its sidewall 122.

In one embodiment, the pot 120 and the shroud 130 may be formed as a single unitary part or be fixedly secured together, such that they are intended to always be utilized together, as shown in FIG. 6. In another embodiment, the pot 120 and the shroud 130 may be formed as separate parts that may be fixedly secured together (e.g., by welding), and are again intended to always be utilized together. In yet another embodiment, the pot 120 and the shroud 130 may be formed as separate parts that may be temporarily joined together and similarly utilized as seen in FIG. 6, being deliberately joined as a result of the heating process, due to greater expansion of the side wall of the pot that forces it into engagement with the shroud (i.e., a cryogenically induced interference fit that remains until the apparatus has sufficiently cooled). In yet another embodiment, the pot may be received in a clearance fit within the shroud and is intended to be utilized separately after heating (see FIG. 7 and FIG. 8).

For at least the first two above-noted versions of the apparatus, the separate shroud may be configured to extend down from a bottom portion of the pot 120, either from its bottom wall 121, or from a portion of the side wall 122, or from a radiused transition between the bottom wall and side wall.

As seen in FIG. 1, the shroud 130 may be formed as a cylindrical side wall 133 that extends from a bottom 131 to a top 132, and which may have a plurality of vent holes 134 formed therein. The shroud 130 may also be formed to include a handle 135, that may be configured in any suitable manner (e.g., as shown in FIG. 1 and FIG. 3), and may preferably have a graspable cross arm 136 that is positioned up and away from the bottom 131 of the shroud, and away from the side wall 122. Because of the proximity of the handle 135 to the heating chamber 210, the handle may also have an insulting material applied thereto, to permit handling by the user. Any suitable insulating material may be used. In one embodiment, the insulating material may be a layer of fiberglass. In another embodiment, a helical member 137 may be coiled around the cross arm 136, to provide for more comfortable handling by the user and to prevent direct contact of the user's hand with the cross arm, which may have been heated to an uncomfortably high temperature. Also, to prevent the pivotable handle 123 of the pot 120 from resting in a static position that is close to the heat chamber 210 (or the pot), where it may become excessively hot to grasp, a post 138 may protrude upwardly from the shroud 130 and support the pot handle 123 as shown in FIG. 3. The post 138 may alternatively protrude upwardly from the heat chamber 210.

The heat chamber 210 may include a base wall portion 214 which may be substantially flat, and which may transition into a cylindrical side wall 213. The cylindrical side wall 213 may preferably be configured (i.e., be sized diametrically) to slidably receive the cylindrical wall 133 of the shroud therein using a sufficiently generous clearance fit that would preclude a cryogenic locking engagement of the two parts when the pot 120 is heated to make the tar suitably viscous.

Figure 1A:
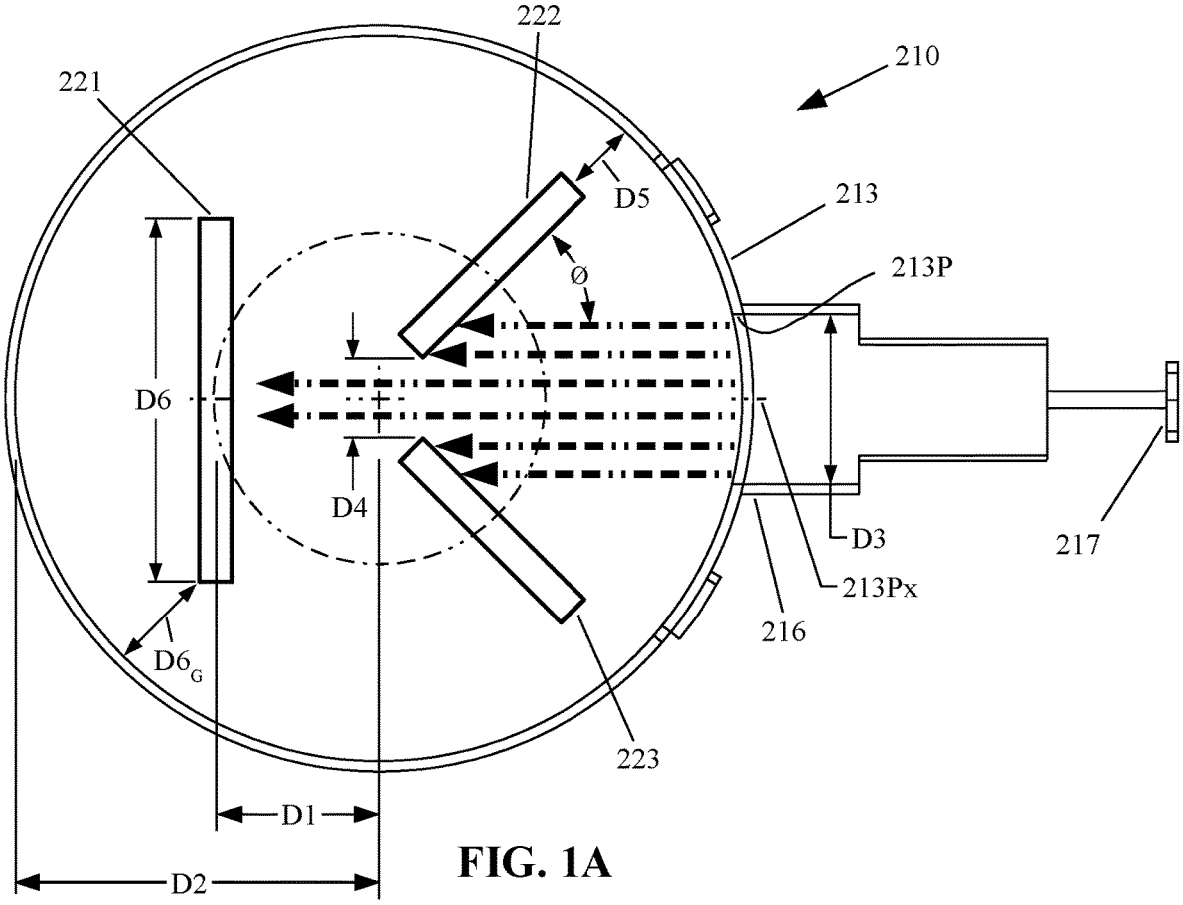
FIG. 1A is a cross-sectional view through the heat chamber shown in FIG. 1.
Figure 4:
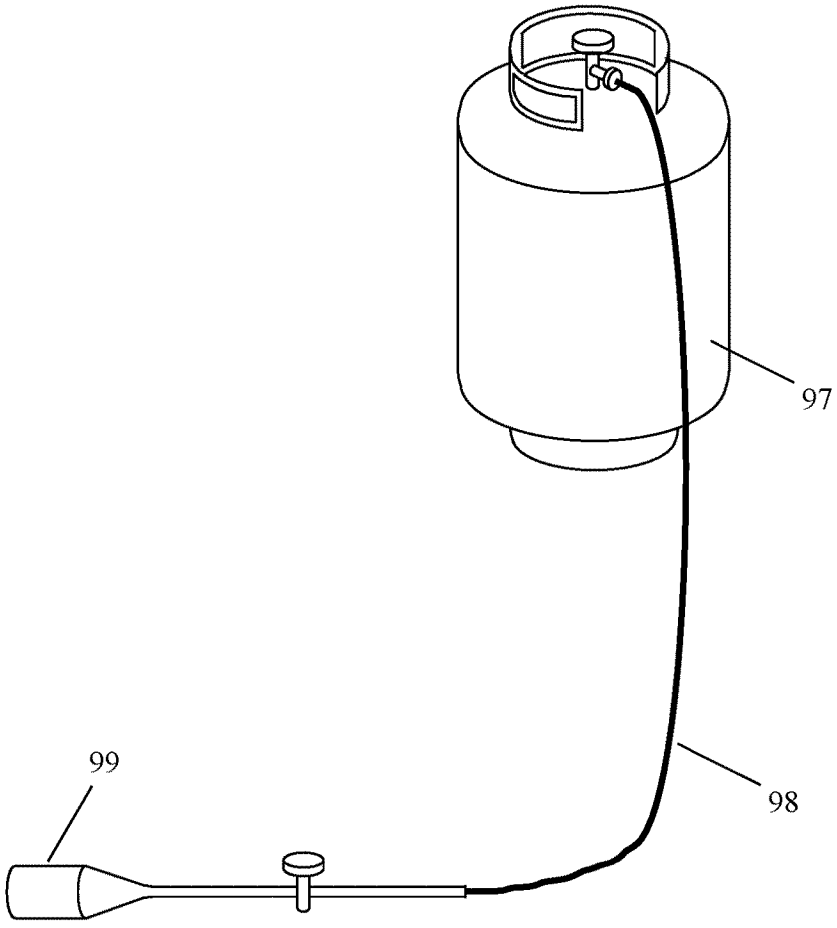
FIG. 4 shows the hand-carryable apparatus for heating tar or the like as shown in FIG. 3, just prior to receiving a torch that is fueled by a propane tank.
Figure 4:
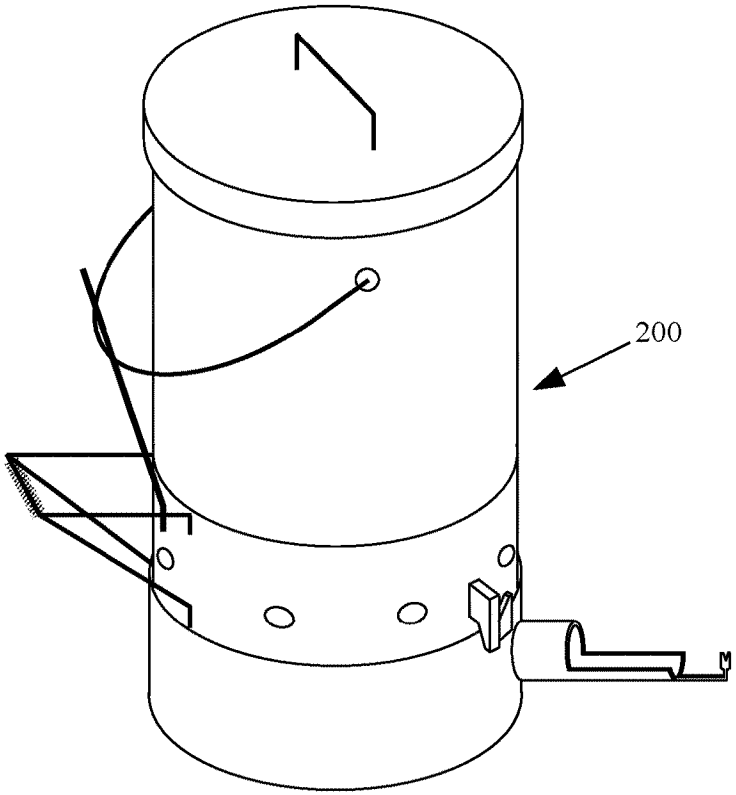
Figure 5:
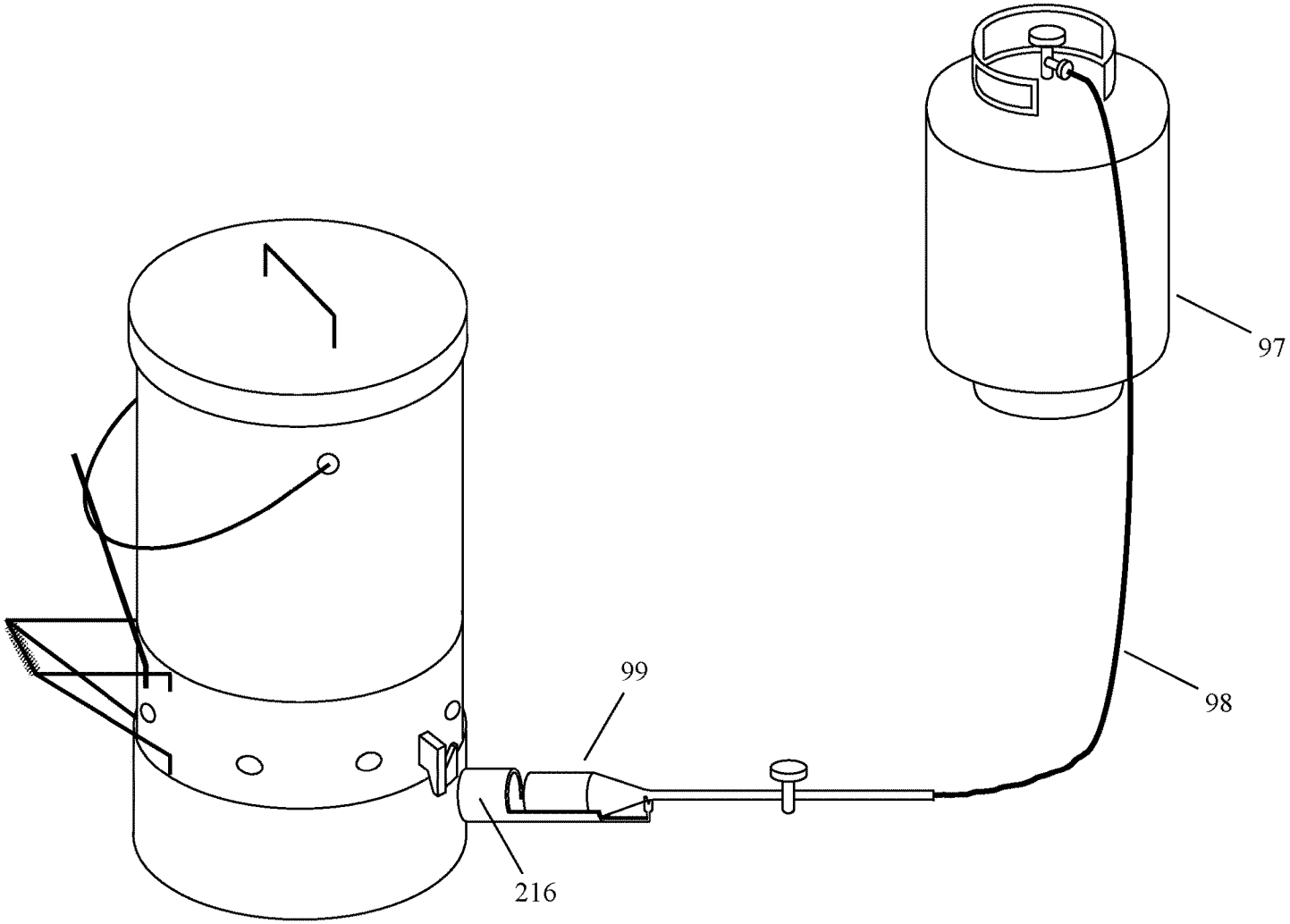
FIG. 5 shows the hand-carryable apparatus for heating tar or the like as shown in FIG. 4, but is shown just after receiving the torch in the holder of the heating chamber.

As may also be seen in FIG. 1A, the heat chamber 210 may have an opening 213P in the cylindrical side wall 213, which opening may be sized and configured to receive the heat from the flame end of a torch 99, which may be a standard torch that may receive and use propane through a hose 98 from a propane tank 97 (see FIG. 5). Note that other fuels and other torch types may alternatively be used. The heat chamber 210 may also have a hollow cylindrical protrusion 216 configured to extend away from the opening 213P in the cylindrical side wall 213, which cylindrical protrusion may be used to receive and support the flame end of the torch in a substantially horizontal position (see FIGS. 4 and 5). The top of the cylindrical protrusion 216 may be sculpted (i.e., may be cut away) to permit laying of the end of the torch 99 directly on the interior surface of a bottom portion of the cylinder, as seen in FIG. 5. The interior cylindrical surface of the cylindrical protrusion 216 may preferably be coterminous with the profile of the opening 213P in the cylindrical side wall 213 (see FIG. 1A), so that there is no obstruction to the heat delivered from the torch flame into the interior of the heat chamber 210. The interior cylindrical surface of the cylindrical protrusion 216 may also be sized (i.e., using a clearance fit) to permit sliding of the head of the torch into the interior of the chamber. Many such torches that are on the market have a long solid extension that includes a shut-off valve, the end of which extension may be coupled a hose 98 that couples the torch to the propane tank 97. To better support this extension of the torch 99, the distal end of the sculpted cylindrical protrusion 216 may have a V-shaped protrusion 217 that extends upwardly such that it may support the solid extension while the main body of the torch is cradled in the protrusion 216, so that the torch may lie substantially horizontally.

The heat chamber 210 also has a plurality of particularly positioned and sized baffles that are configured to protrude upwardly from its base wall 214. In one embodiment, the plurality of baffles may include: a first baffle 221, a second baffle 222, and a third baffle 223.

The first baffle 221 may be substantially flat, and may be positioned distally from the opening 213P in the side wall 213 of the heat chamber 210 to facilitate distributing (radiating) of heat within the chamber, i.e., being positioned between the center of the bottom wall 214 and the far side of the circular wall 215 opposite opening 213P, as seen in FIG. 1A. In one embodiment, distance D1 is one-half of distance D2, and in another embodiment, distance D1 is within about 10-20 percent of distance D2. The first baffle 221 may also be oriented substantially perpendicular to the axis 213Px of the opening 213P, and is preferably substantially centered with respect to the axis. The first baffle 221 may also have a length D6 that leaves a gap D6G between each of its ends and the sidewall of the heat chamber. In another embodiment, rather than being flat, the first baffle 221 may be curved (not shown), and may have a radius of curvature that makes it substantially concentric with the cylindrical side wall 213 of the heat chamber 210.

The second baffle 222 and a third baffle 223 may also be substantially flat, and may be positioned between the first baffle and the opening 213P in the side wall of the heat chamber. The second and third baffles 222/223 are preferably oriented at an acute angle θ with respect to the axis 213Px of the opening 213P, as seen in FIG. 1A. Each of the second and third baffles 222/223 may be roughly at an angle to the first baffle 221 being in the range of 30 degrees to 60 degrees, and may more preferably be in the range of 40-50 degrees, and may most preferably be at about and angle of 45 degrees. The second and third baffles 222/223 are also substantially symmetrically offset with respect to the axis of the opening, being separated from each other, as shown in FIG. 1A, so that some of the heat from the torch 99 may be directed straight at the first baffle 221, while some of the heat from the torch may be directed at each of the angled second and third baffles 222/223. Some of the heat received by each of the second and third baffles 222/223 may be absorbed and would be re-radiated, while some of the heat directed at those two baffles may be deflected and directed to the first baffle 221. To roughly equally distribute the heat provided by the torch between each of the three baffles, a gap D4 between the first end of the second baffle 222 and the first end of the third baffle 223 is in the range of about one-quarter to one-half of a lateral extent of the opening 213P, and is most preferably about one-third of the lateral extent of the opening 213P (i.e., D4 is about one-third the size of D3). The length of each of the second and third baffles 222/223 leaves a respective gap D5, which may be about the same size as gap D6G.

The positioning of the plurality of baffles (e.g., baffles 221/222/223) and the gaps D5 and gap D6G help to distribute the heat beneath the pot 120, so that the pot does not have the torch 99 directing the heat at a single location on its bottom surface, as with certain prior art devices.

In another embodiment, the plurality of baffles, rather than being entirely flat and protruding straight up from the bottom of the heat chamber may instead have a curved bottom portion to induce the flame and/or heat to be gradually directed upwardly along the nearside surface, rather than striking the baffle laterally. Also, other numbers of baffles, and alternative positioning, may also be used.

To limit the sliding engagement of the cylindrical side wall 133 of the shroud 130 within the cylindrical side wall 215 of the heat chamber 210, the side wall of the shroud may have at least one protruding stop member 139. Three or four protruding stop members 139 may be desirably used, being equally spaced apart (i.e., about 120 degrees for three stop members or about 90 degrees apart for four stop members). Also, to establish clocking of the pot 120 with respect to the heat chamber 210, to keep its pivotable handle 123 away from the torch, each protruding stop member 139 may also act as a "key" as it may be received within a corresponding recess 215R (i.e., a keyway—see FIG. 1) in the side wall 215 of the heat chamber 210. Also, an upper surface 218S on at least a pair of plates 218 on the side wall 215 of the heat chamber 210 may act as a cam surface to direct the respective protruding stop member 139 on the pot 120 toward and into the corresponding recess 215R, as one side of the plate 218 may be aligned with one side of the recess 215R. Alternatively, the key and keyway may operate to only establish the desired clocking, without limiting the sliding engagement of the cylindrical side wall 133 of the shroud 130 within the cylindrical side wall 215 of the heat chamber 210 (e.g., by using a greater depth for the keyway, such that the member 139 acts only as a key without providing a stop feature, being a key member).

Since a worker may intermittently/alternately spend time between dispensing the tar from the pot 120, and working the tar into a crack or performing other tasks before returning back to dispensing of the tar, the side wall 133 of the shroud 130 may support the pot distally from a ground surface when the apparatus is placed thereon. Having only the small narrow thickness of the rim of the shroud 130 on the ground while performing those other tasks significantly reduces the amount of heat transfer from the tar and pot, as compared with the direct heat transfer that would occur by placing the entire surface area of the bottom of the metal pot onto the ground. This permits longer use of a batch of tar heated in the pot 120 before reheating may be required.

As noted above, heating of the tar in the pot 120 may be accomplished using the torch 99, as shown in FIGS. 4-5.

Pouring of the heated tar from the pot 120 and shroud 130 combination may be seen in FIG. 6, where the user may grasp the pivotable handle 123 of the pot with one hand, and may maneuver the combination by also grasping and manipulating the handle 135 on the shroud.

Figure 7:
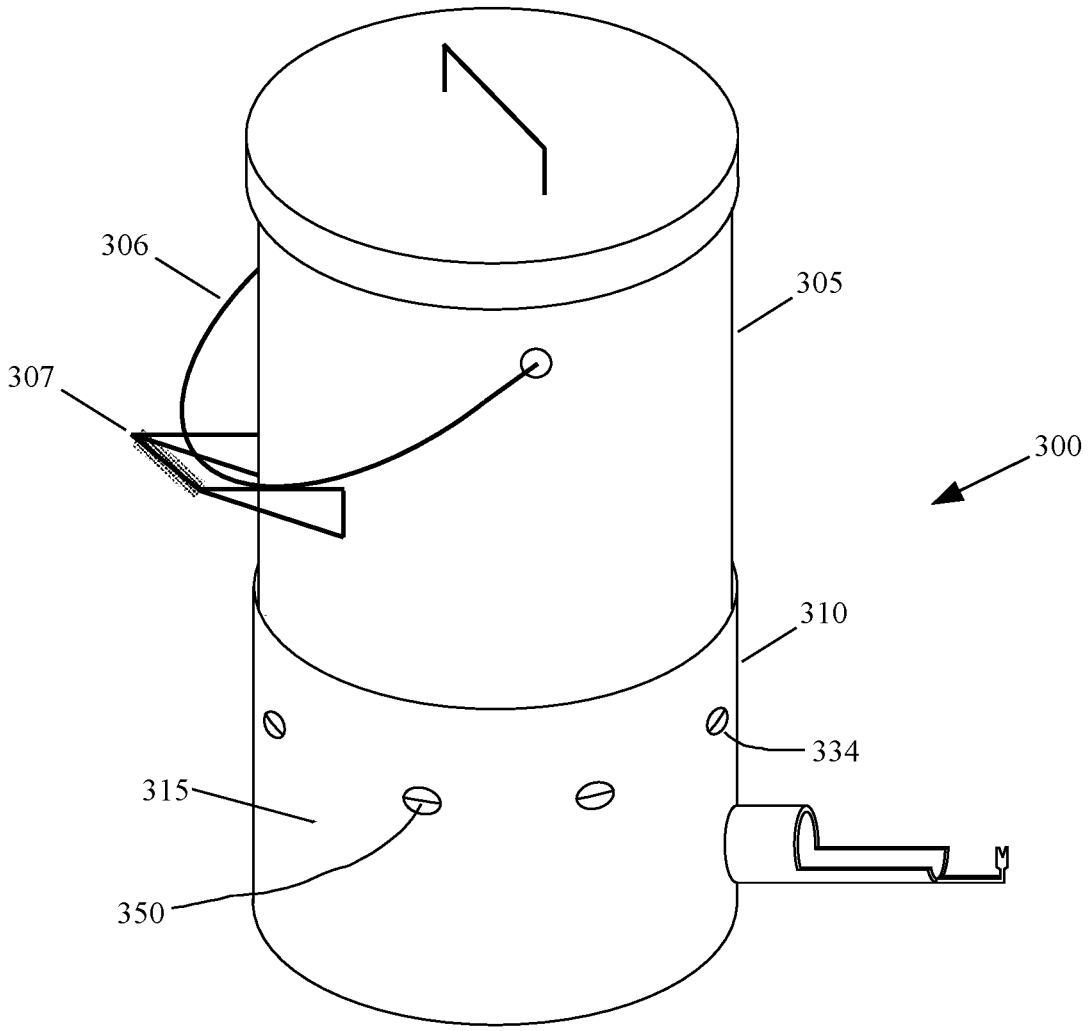
FIG. 7 shows an alternate embodiment of the hand-carryable apparatus for heating tar, bitumen, asphalt, or the like, in which the shroud is integral with the heat chamber, and the pot is slidably received in the top of the heat chamber/shroud for heating, and may rest upon the top of the baffles.
Figure 8:
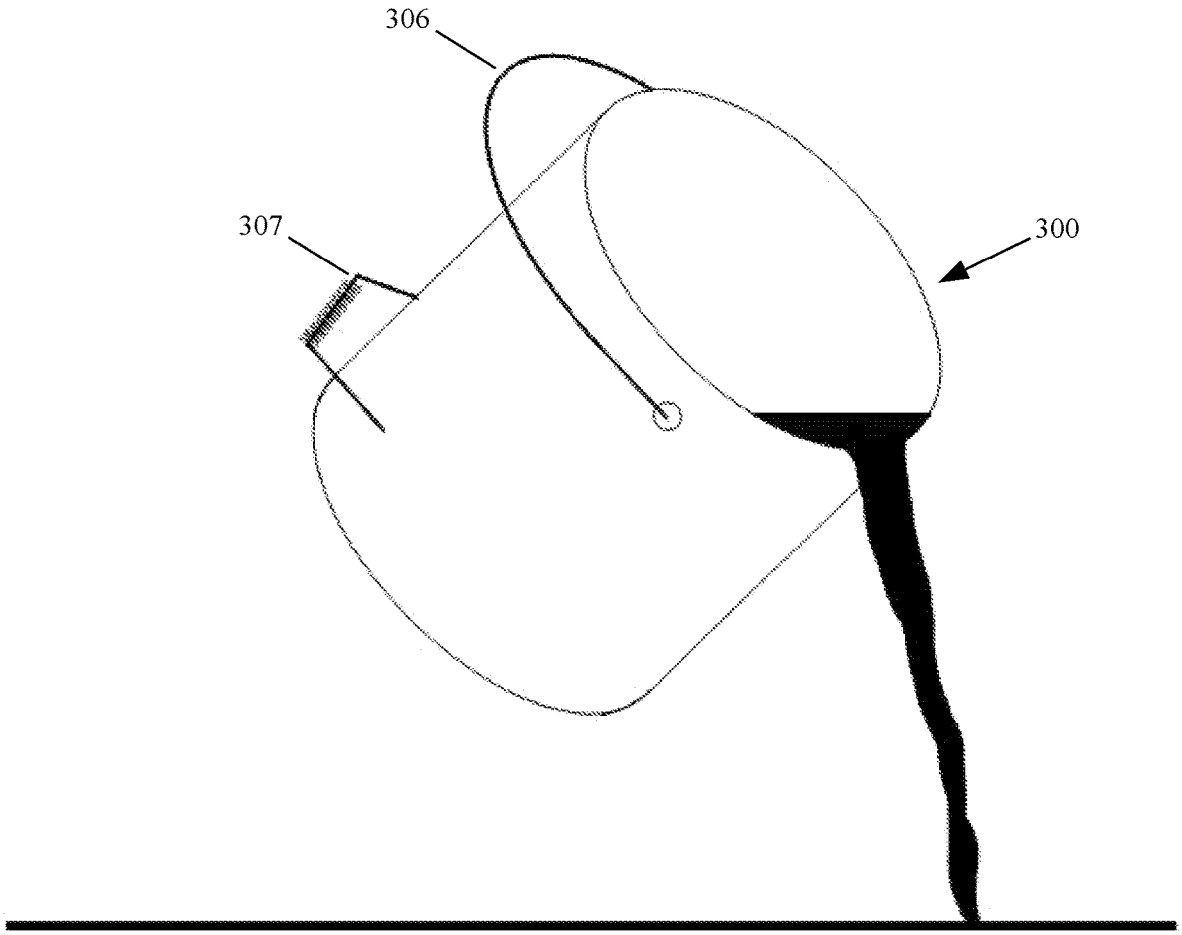
FIG. 8 shows the pot of the hand-carryable apparatus of FIG. 7 after being removed from the shroud, and is shown being held at an angle using two handles on the pot to dispense tar therefrom.

The above-noted embodiment where a pot may be received in a clearance fit within the shroud and is intended to be utilized separately after heating, is shown in FIG. 7 and FIG. 8. The pot 305 may have a pivotable handle 306, and may also have a fixed handle 307 that may be formed similar to the handle 135. The fixed handle 307 may be particularly positioned to prevent the pivotable handle 306 from pivoting too close to the pot 305, in the same manner that the post 138 on the shroud 130 prevents the pivotable handle 123 from touching the sidewall 122 of the pot 120. The wall of the heat chamber 310 may extend upwardly to essentially include the shroud, as it may also have a plurality of vent holes 334 formed therein, the same as the vent holes 134 on the shroud 130. The pot 305 may sit on top of the plurality of baffles in the heat chamber 310, or the heat chamber may instead have a plate 350 fixedly secured to the side wall 315 being at or just above the vent holes, as seen in FIG. 37, so that the pot 305 can rest on the plate.

While illustrative implementations of one or more embodiments of the disclosed apparatus are provided hereinabove, those skilled in the art and having the benefit of the present disclosure will appreciate that further embodiments may be implemented with various changes within the scope of the disclosed apparatus. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A hand-carryable heating and dispensing apparatus configured to heat tar and the like into a flowable state and configured to dispense the flowable tar, said hand-carryable heating apparatus comprising:

a pot, said pot comprising: a bottom wall, and one or more side walls extending away from said bottom wall;

a heat chamber, said heat chamber comprising:

a base member, and one or more side members extending away from said base member;

an opening in said one or more side members, said opening sized and configured to receive a flame of a torch; and a plurality of baffles, each of said plurality of baffles being selectively positioned and configured to protrude upwardly from said base member;

a handle, wherein said handle is configured to permit removal of said pot from said heat chamber after being heated, and to permit carrying of said pot;

wherein said plurality of baffles comprises:

a first baffle, said first baffle being positioned distally from said opening in said one or more side members of said heat chamber; and wherein said first baffle is oriented substantially perpendicular to an axis of said opening, and is substantially centered with respect to the axis of said opening;

a second baffle and a third baffle, said second and third baffles being positioned between said first baffle and said opening in said one or more side members of said heat chamber; and wherein said second and third baffles are oriented at an acute angle with respect to the axis of said opening, and are substantially symmetrically positioned with respect to the axis of said opening.

2. The hand-carryable heating and dispensing apparatus according to claim 1, wherein said second and third baffles are positioned with a gap between a first end of said second baffle and a first end of said third baffle; wherein said second baffle is positioned with a gap between a second end of said second baffle and said one or more side members of said heat chamber; and wherein said third baffle is positioned with a gap between a second end of said third baffle and said one or more side members of said heat chamber; and wherein said gap between said first end of said second baffle and said first end of said third baffle is in the range of about one-quarter to one-half of a lateral extent of said opening.

3. The hand-carryable heating and dispensing apparatus according to claim 2, wherein said first baffle is positioned about midway between a center of said bottom wall of said base member, and a distal side of said side wall being opposite to said opening.

4. The hand-carryable heating and dispensing apparatus according to claim 3, wherein said second and third baffles are oriented with respect to the axis of said opening at an angle in the range of 30 degrees to 60 degrees.

5. The hand-carryable heating and dispensing apparatus according to claim 3, wherein said second and third baffles are oriented with respect to the axis of said opening at an angle in the range of 40 degrees to 50 degrees.

6. The hand-carryable heating and dispensing apparatus according to claim 3, wherein said second and third baffles are oriented with respect to the axis of said opening at an angle of 45 degrees.

7. The hand-carryable heating and dispensing apparatus according to claim 4, wherein said second and third baffles are each positioned between said center of said base member of said heat chamber and said opening in said one or more side members of said heat chamber.

8. The hand-carryable heating and dispensing apparatus according to claim 7, wherein said heat chamber comprises: a cylinder configured to protrude laterally away from said one or more side members to enclose said opening, said cylinder configured to receive and support the torch.

9. The hand-carryable heating and dispensing apparatus according to claim 8, further comprising:

a shroud, said shroud comprising one or more side walls configured to extend away from a portion of said pot;

wherein said one or more side members of said heat chamber are configured to slidably receive said one or more walls of said shroud therein in a clearance fit;

wherein said one or more side walls of said shroud are configured to support said bottom wall of said pot distally from a ground surface when placed thereon during intermittent dispensing of the tar from said hand-carryable heating apparatus.

10. The hand-carryable heating and dispensing apparatus according to claim 9, further comprising means for limiting said sliding reception of said or more walls of said shroud into said one or more side members of said heat chamber to a desired depth.

11. The hand-carryable heating and dispensing apparatus according to claim 10, wherein said handle is pivotally mounted to said one or more sidewalls of said pot.

12. The hand-carryable heating and dispensing apparatus according to claim 11, further comprising: a second handle, said second handle being positioned to permit pouring of the tar from said pot in combination with said first handle.

13. The hand-carryable heating and dispensing apparatus according to claim 12, further comprising:

a post configured to protrude upwardly from said shroud, being positioned to support said pivotable handle at a distance away from said pot.

14. The hand-carryable heating and dispensing apparatus according to claim 13, wherein said one or more side members of said heat chamber comprises: a first keyway, and a second keyway;

wherein said shroud comprises: a first key member, and a second key member; and wherein said first and second key members are configured to be received in said first and second keyways of said heat chamber to clock said post about 180 degrees away from said opening.

15. The hand-carryable heating and dispensing apparatus according to claim 14, wherein said second handle is fixedly secured to said shroud.

16. The hand-carryable heating and dispensing apparatus according to claim 15, wherein each of said first, second, and third baffles are substantially flat.

17. The hand-carryable heating and dispensing apparatus according to claim 16, further comprising: a plurality of openings in said one or more side members of said shroud.

18. The hand-carryable heating and dispensing apparatus according to claim 17, wherein said one or more side walls of said pot form a cylindrical wall; and wherein said one or more side members of said heat chamber form a cylindrical wall.

19. The hand-carryable heating and dispensing apparatus according to claim 18, wherein said shroud is integrally formed with said pot.

20. The hand-carryable heating apparatus according to claim 18, wherein said shroud is formed as a separate part and is fixedly secured to said pot.

* * * * *